US005209021A

United States Patent [19]

Christie et al.

[11] Patent Number: 5,209,021

[45] Date of Patent: May 11, 1993

[54] APPARATUS AND METHOD FOR SPRUE REMOVAL AND GRINDING OF RAILROAD WHEELS

[75] Inventors: C. Dale Christie, Naperville; Charles W. Taff, Fox Lake; Jaime F. Pozo, Chicago, all of Ill.

[73] Assignee: Amsted Industries, Inc., Chicago, Ill.

[21] Appl. No.: 753,037

[22] Filed: Aug. 30, 1991

[51] Int. Cl.[5] ..... B24B 5/26; B24B 9/00

[52] U.S. Cl. ..... 51/104; 51/99; 51/105 EC; 51/106 R

[58] Field of Search ..... 51/103 R, 104, 105 R, 51/105 EC, 106 R, 165.9, 99, 236, 237

[56] References Cited

U.S. PATENT DOCUMENTS

| | | | |
|---|---|---|---|
| 2,678,678 | 5/1954 | Kuechenmeister | 51/106 R |
| 3,455,065 | 7/1969 | Shiomi | 51/104 |
| 3,688,443 | 9/1972 | Hohler | 51/103 R |
| 3,977,131 | 8/1976 | Searle | 51/106 R |
| 4,084,350 | 4/1978 | Ongaro | 51/106 R |
| 4,663,889 | 5/1987 | Strand | 51/106 R |
| 5,044,124 | 9/1991 | Niimura | 51/99 |

*Primary Examiner*—Bruce M. Kisliuk
*Assistant Examiner*—Bo Bounkong
*Attorney, Agent, or Firm*—Edward J. Brosius; F. S. Gregorczyk; Thomas J. Schab

[57] ABSTRACT

An apparatus for grinding cast steel railroad wheels is provided. The apparatus comprises a railroad wheel support assembly that includes a roller assembly to receive and grasp the railroad wheel and rotate the railroad wheel about its center axis. A grinding assembly is also provided that includes a motor operatively connected to a grinding wheel. The motor and grinding wheel are mounted to a support assembly. The railroad wheel support assembly oscillates about an axle assembly during grinding. The grinding assembly is designed to advance the grinding wheel laterally into the railroad wheel during grinding. The lateral advancing of the grinding wheel and oscillating of the railroad wheel are controlled to achieve a finish grinding of the selected surface of the railroad wheel to a preselected contour.

11 Claims, 5 Drawing Sheets

APPARATUS AND METHOD FOR SPRUE REMOVAL AND GRINDING OF RAILROAD WHEELS

BACKGROUND OF THE INVENTION

The present invention relates to an apparatus for grinding railroad wheels, and more particularly, an apparatus for the sprue removal and finish grinding of cast steel railroad wheels.

The preferred method for manufacturing cast steel railroad wheels is the bottom pressure casting foundry operation wherein molten steel under pressure is forced upwardly into a graphite mold and filled from the bottom upwardly. This bottom pressure casting operation eliminates many of the concerns associated with traditional top pouring molten steel in foundry operations such as splashing and insufficient filling of molds. In the casting of railroad wheels, it is usual for the front side of the wheel, which also corresponds with the top half of the mold, to have a raised center hub portion and, depending on the size of the wheel, from 6 to 14 raised sections or sprues extending from the plate portion of the wheel near the rim. The raised hub area and the raised sprue areas extending from the plate are remnants of risers that are designed to hold additional metal to be available to fill downwardly into the mold during the cooling and solidification of the wheel just after pouring. The center raised hub section is removed during the flame cutting of the axle hub, which is later finished by a hub-boring operation. The sprues are difficult to remove and would require considerable effort if removed by normal-sized, hand-held grinders. In fact, such hand-held grinding operation is not currently used in present wheel-making operations. The current method for removal of such sprues is a so-called sprue washing operation which amounts to a carbon arc melting of the raised sprue. A hollow electrode is utilized to electrically melt the sprue with air blown through the hollow portion of the electrode to blow away the molten metal. This operation is like carbon arc welding but with no material depositing. However, removed molten metal is deposited on adjacent sections of the wheel which requires subsequent chipping away which is a time consuming and difficult process. Further, the sprue washing operation is not a desirable work area as the operators must wear a protective suit with a separate airhood supply and adequate noise protection.

After such sprue washing and chipping operations are completed, the cast steel wheel must be heat treated by raising its temperature, allowing it to cool, cleaning the wheel by a shot-blast operation, and then finish grinding the surface areas from which the sprues were removed. Such finish grinding is a typical hand-grinding operation and again a difficult process for the operator.

Machine grinding of ingots and billets are known in the steel industry. Typically, such operation amounts to scarfing of the ingot's surface to remove minor cracks or surface imperfections after the ingot has cooled, although certain scarfing operations are preferred when the ingot is at an elevated temperature. Applicants are not aware of any operation wherein sprues are removed from cast steel railroad wheels when the wheel has just solidified from the initial casting operation.

SUMMARY OF THE INVENTION

Accordingly, it is an object of the present invention to provide an apparatus for the automatic grinding removal of sprues from a cast steel railroad wheel shortly after the wheel has been cast and solidified.

It has been discovered that it is advantageous to remove the sprues from cast steel railroad wheels when the wheel has cooled from initial casting to a temperature of from 800°–1,200° F. (425°–650° C.). It should be understood that such grinding could be accomplished when the wheel has cooled to ambient temperature, although it is preferred to perform such grinding when the wheel is at such elevated temperature. Such grinding is accomplished by a heavy grinding wheel or stone in the order of 25-inch diameter by 3-inches wide (63 cm×7.6 cm) driven by a relatively large direct drive connected variable AC electric motor of a size 200–250 horsepower.

It is understandable that it takes less energy to remove such sprues when the wheel is relatively hot at the temperatures indicated, because the metal at such temperatures has lower yield and tensile strength than when cooled to ambient temperatures. It is understood that the energy to remove such sprues when the wheel is at such temperatures can be up to 50 percent less than the energy requirements to remove the sprues when the wheel is at ambient temperature. Additional advantages of the removal of sprues by the grinding operation of the present invention is that the relatively rough operation of sprue removal and the finish grinding of the wheel to the final contour in the sprue areas can be accomplished in a single operation with the same grinding wheel. However, it may be desirable to perform finish grinding using a finer grinding wheel or stone in a subsequent operation with a similar apparatus. It should also be understood that the wheel resulting from the hot grinding operation of the present invention has better fatigue resistance than a wheel which has cooled and then is ground and there subjected to a sprue-washing operation to remove the sprues. Such better fatigue resistance allows the wheel to withstand higher stresses before any fatigue cracking.

In the apparatus of the present invention, a railroad wheel is loaded into a wheel support assembly. The wheel support assembly includes roller mechanisms whereby the wheel is held and also can be rotated about its center axis. The wheel support assembly itself is capable of oscillating motion.

The grinding apparatus of the present invention includes a relatively high horsepower motor in the neighborhood of 200–250 horsepower mounted on a grinding support structure. The output motor shaft is directly connected to a grinding wheel spindle assembly to which the grinding wheel itself is attached. The grinding wheel itself is a relatively large wheel in the neighborhood of 24-inches (63 cm) in diameter and 3-inches (7.6 cm) in width. The grinding wheel motor support structure itself is movable laterally toward the railroad wheel such that the grinding wheel can be brought into contact with the surface of the railroad wheel to be ground. The oscillation of the railroad wheel and its support structure about a support shaft and the movement of the grinding wheel support structure about a support axle are both controlled and programmed such that the sprues on the railroad wheel are removed to leave the ground surface of the railroad wheel in a finished ground condition corresponding to a known and preselected surface contour.

DETAILED DESCRIPTION

Figure 1:
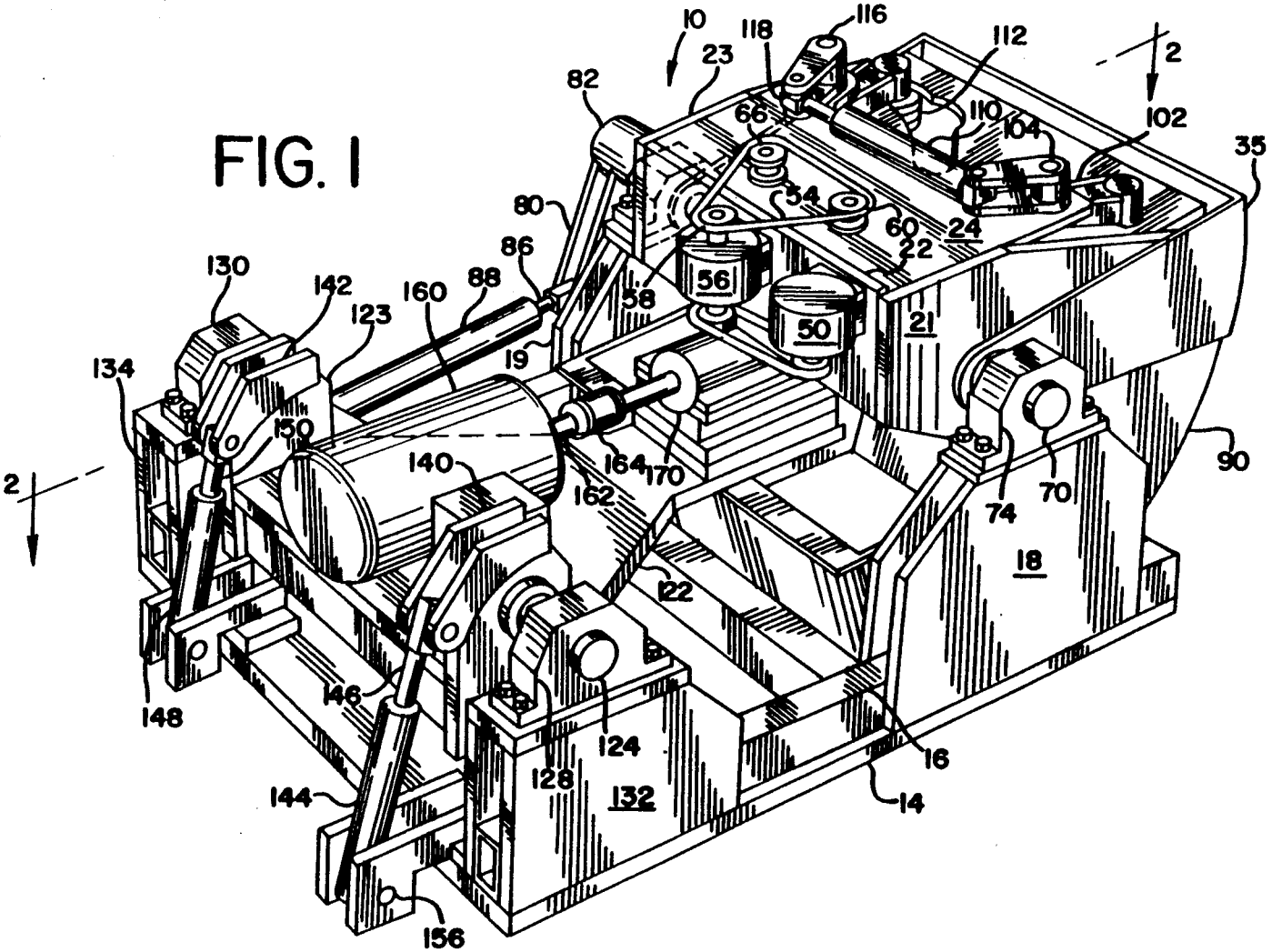
FIG. 1 is a perspective view of a grinding machine in accordance with the present invention.

Referring now to FIGS. 1-4 of the drawings, a railroad wheel grinding machine in accordance with a preferred embodiment of the present invention is shown generally at 10. Grinding machine 10 is comprised of largely structural steel components welded or bolted as necessary to form a rugged machine capable of grinding cast steel railroad wheels. Grinding machine 10 is comprised of base frame 12, which itself is comprised of a base frame plate section 14 strengthened with several box girders 16 welded along the top surface of the width of base frame plate 14. Base frame plate 14, along with most other frame plates utilized to construct grinding machine 10, is most frequently comprised of a steel plate from 1 to 2-inches (2.5-5 cm) in thickness. A general idea of the size of grinding machine 10 can be achieved from observing that base frame plate 14 most typically is about 8-feet by 12-feet (about 2.5m×4m).

Wheel support frame posts 18 and 19 extend upwardly from base frame plate 14. It is generally desirable for wheel support frame posts 18 and 19 to comprise spaced plate structures which straddle a base frame structural component 16. Wheel support frame posts 18 and 19 are most typically welded to base frame plate 14 and base frame structural 16.

Wheel support frame base plate 20 is a generally square or rectangular metal plate, usually made of steel of a thickness of about 2-inches (5 cm).

Wheel support frame backing plate 22 is a generally rectangular metal plate usually made of steel affixed to a longitudinal edge of wheel support frame base plate 20. Such affixation is usually accomplished by welding. Wheel support frame upper plate 24 is welded along its longitudinal edge to an upper section of wheel support frame backing plate 22 and extends parallel and above wheel support frame base plate 20. Side plates 21 and 23 join upper plate 24 and base plate 20. Wheel support frame flange extension 26 and wheel support frame flange extension 30 extend downwardly from lateral edges of wheel support frame base plate 20. Both wheel support frame flange extensions 26 and 30 are flat metal plates, generally made of steel and are welded along the lateral bottom edge of wheel support frame base plate 20. Wheel support frame flange extension 26 includes a circular opening 28 and wheel support frame flange extension 30 includes a circular opening 32 therein.

Wheel support frame axle 70 extends through opening 28 in wheel support frame flange extension 26. It should be understood that wheel support frame axle 70 is also received in appropriate wheel support bearing 74 which itself is fixed to the top of wheel support frame post 18. Similarly, wheel support frame axle 72 is received in opening 32 in wheel support frame flange extension 30 and is also received in appropriate wheel support bearing 76. Wheel support bearing 76 is mounted on top of wheel support frame post 19.

Lever assembly 80 is affixed to an end of wheel support frame axle 72 by joining to axle cap 82. An end of lever assembly 80 accepts a pin assembly 84 which also receives an end of hydraulic operating cylinder 88 piston end 86. The other end of hydraulic operating cylinder 88 is affixed by an appropriate pin mechanism to a raised section 90 extending upwardly from base frame plate 14.

Loading arm 33 is utilized to bring railroad wheel 34 through entry gate 35 into the wheel support frame assembly. Also referring to FIG. 5, it will be seen that cast steel railroad wheel 34 is comprised of plate section 36 extending between rim section 38 and hub section 40. Flange section 46 extends from rim 38. Centrally located hub section 40 includes a riser section 42 which extends upwardly in the wheel mold. A plurality of sprues 44 also extend upwardly from the section of plate section 36 near rim section 38. It is sprues 44 that are designed to be removed in the grinding machine of the present invention.

Entry gate 35 is part of a chute arrangement comprising sides 90 and 92 which act to funnel the materials ground from railroad wheel 34 downwardly for collection in a hopper. It is also seen that wheel support frame base plate 20 contacts entry gate 35 to effectively seal railroad wheel 34 within an enclosed structure. Such enclosure of railroad wheel 34 during the grinding operation eliminates virtually all fumes and particles associated with the grinding operation. As pointed out above, such ground materials are allowed to fall through chute arrangement sides 90 and 92 into a collection hopper. Operating cylinder 94 includes piston 96 which is attached by appropriate pin means to the outer surface of door of entry gate 35 thereby enabling the opening and closing of entry gate 35 by the retraction and extension, respectively, piston 96 of operating cylinder 94.

Figure 3:
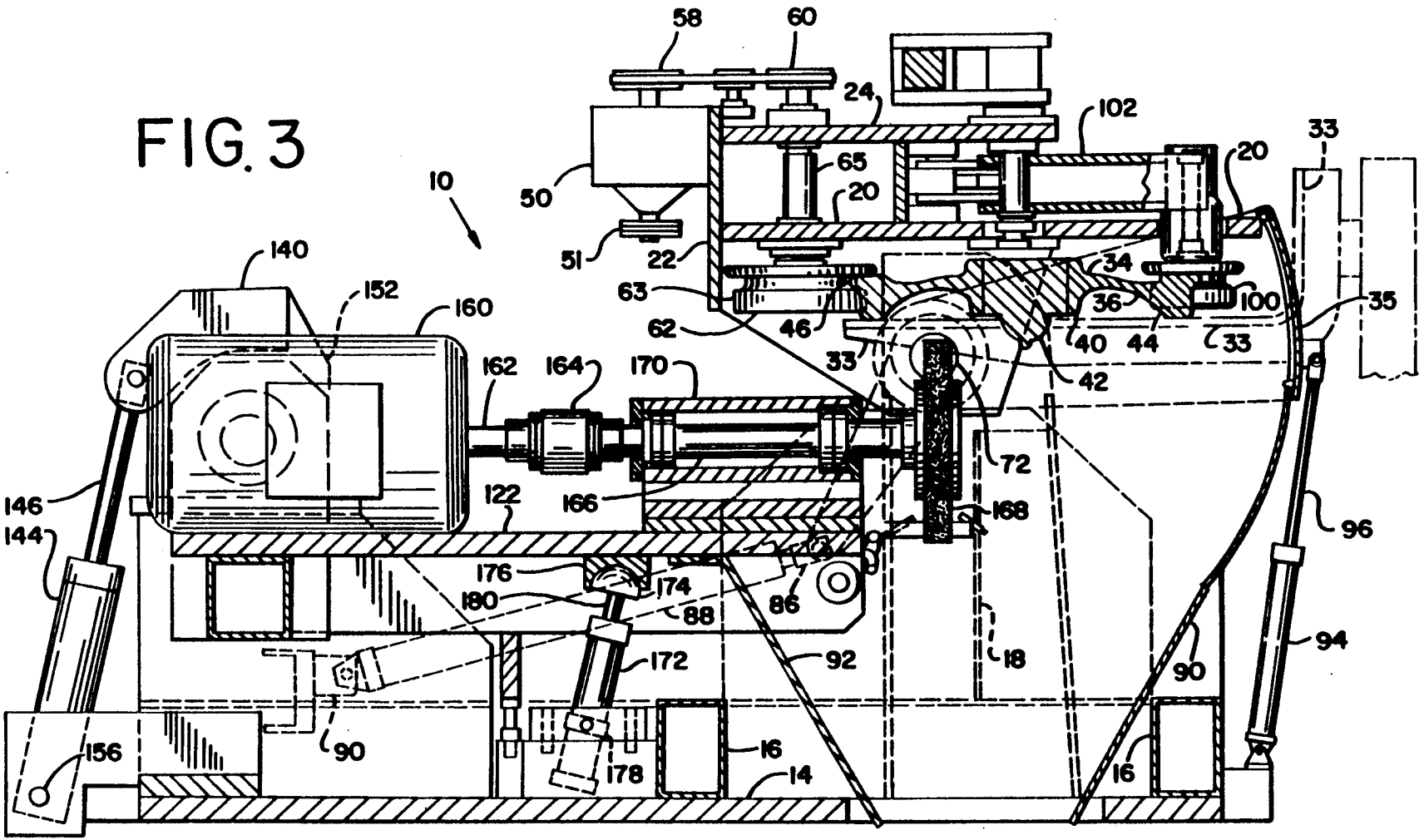
FIG. 3 is a side view of a grinding machine in accordance with the present invention.
Figure 4:
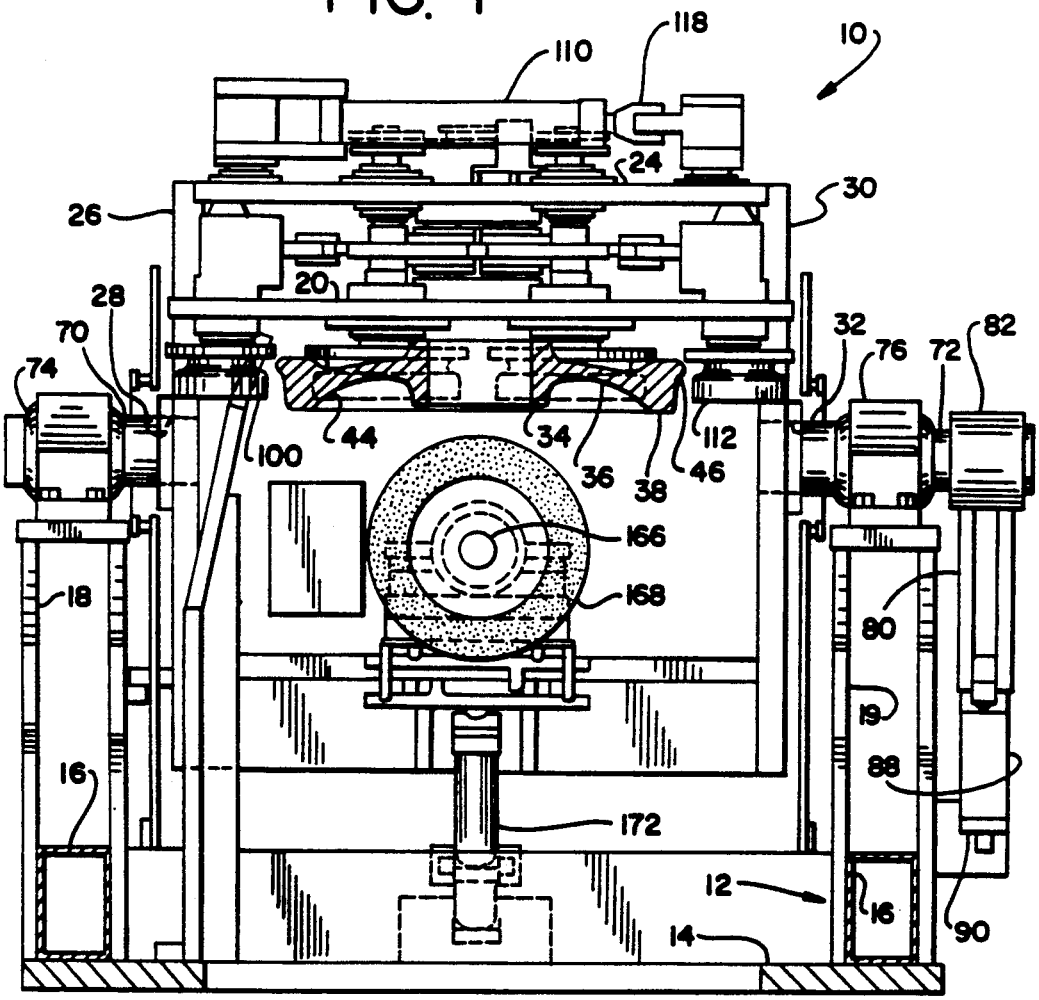
FIG. 4 is an end view of a grinding machine in accordance with the present invention.

Railroad wheel support drive motor 50 is attached to the outer surface of wheel support frame backing plate 22 near a lateral edge thereof. Wheel support drive motor 50 is usually an electric motor of about 15 horsepower. Output sheave 51 of railroad wheel support drive motor 50 is on the bottom of the motor as installed and is connected by wheel support drive motor belt 52 to similar sheave on the bottom of gear reducer 56. Gear reducer 56 is also attached to the outer surface of wheel support frame backing plate 22 at about the center lateral portion thereof. It is also possible to mount drive motor 50 such that its output shaft is directly connected to gear reducer 56. Output sheave 58 of gear reducer 56 is connected by gear reducer output belt 54 to two drive roller input sheaves 60 and 66. Drive roller input sheave 60 is connected to a shaft extending from the top of railroad wheel support drive roller 62 and drive roller input sheave 66 is attached to a sheave extending from the top of railroad wheel support drive roller 64. Railroad wheel support drive roller 62 is similar to railroad wheel support drive roller 64 and, as best seen in FIG. 3, railroad wheel support drive roller 62 includes a shaft assembly 65 affixed to both wheel support frame base plate 20 and wheel support frame upper plate 24. Railroad wheel support drive roller 62 includes roller head 63 having an edge with an inlet portion adapted to receive flange 46 of railroad wheel 34.

Figure 2:
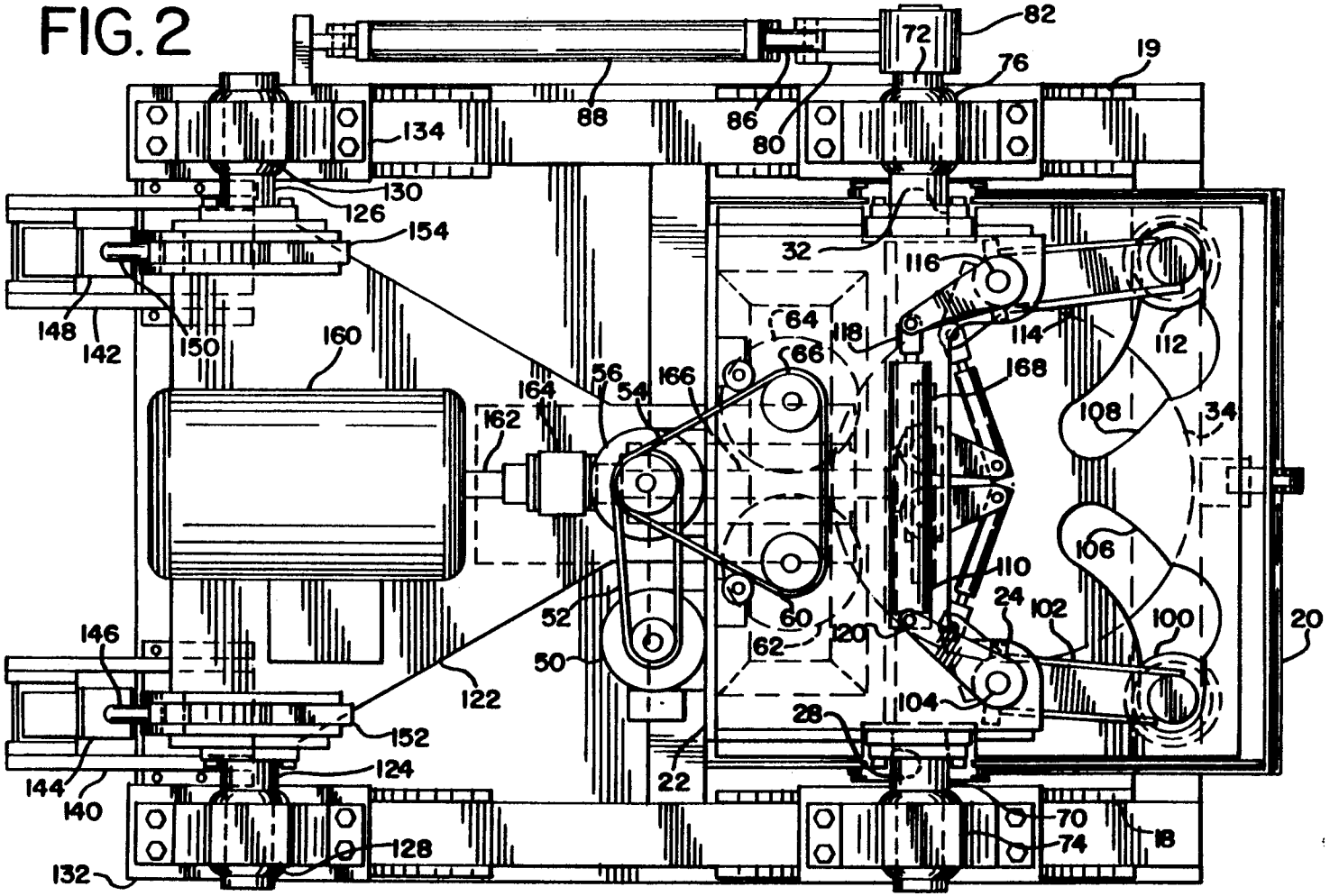
FIG. 2 is a top view, in partial cross section, of a grinding machine in accordance with the present invention.

As seen in FIGS. 2 and 3, railroad wheel support roller 100 is affixed to an end of support roller arm 102 which itself is attached to a pivot 104. The other end of support roller arm 102 is attached to an end of railroad wheel support roller 110. Similarly, railroad wheel support roller 112 is affixed to an end of support roller arm 114 which itself is supported at pivot point 116. The other end of railroad wheel support roller arm 114 is attached to piston end 118 of actuating cylinder 110. Upon extension of piston 118, both support roller arms 102 and 114 are rotated about pivot point 104 and 116, respectively, such that railroad wheel support rollers 100 and 112 are brought inwardly to contact the rim of railroad wheel 34. Upon such contact, railroad wheel 34 rim is also brought into contact with roller head 63 of railroad wheel support drive roller 62 and the similar head of railroad wheel support drive roller 64 such that railroad wheel 34 is supported by support drive rollers 62 and 64 and railroad wheel support rollers 100 and 112. It should be understood that support rollers 100 and 112 are spread to their lateral maximum open position when loading arm 33 brings railroad wheel 34 into grinding machine 10 through entry gate 35. Prior to the removal of loading arm 33, railroad wheel support rollers 100 and 112 are brought into contact with railroad wheel 34 rim section 38 to support railroad wheel 34. Upon such support, loading arm 33 is removed through open entry gate 35, and entry gate 35 is then closed by actuation of operating cylinder 94 and piston 96 whereby railroad wheel 34 is held by support rollers 100 and 112 and drive rollers 62 and 64. Arcuate cutout section 106 is provided in wheel support frame base plate 20 to accommodate the arcuate movement of railroad wheel support roller 100. Similarly, arcuate cutout section 108 is also provided in wheel support frame base plate 20 to accommodate the arcuate movement of railroad wheel support roller 112.

As seen in FIG. 2, hydraulic operating cylinder 88 is connected by a pivot at point 90 to an extension from base frame plate 14. Piston 86 of hydraulic operating cylinder 88 extends and is connected by appropriate pin means to arm lever assembly 80 extending from axle cap 82 which is affixed to the end of wheel support frame axle 72. Upon extension of hydraulic operating cylinder piston 86, wheel support frame axle 72 is rotated in bearing 76 such that the wheel support frame flange extension 30 and the entire wheel support frame assembly is rotated about wheel support frame axles 70 and 72. Upon the extension and retraction of hydraulic operating cylinder piston 86, the wheel support frame assembly can be oscillated about wheel support frame axle 70 and 72. Upon full retraction of hydraulic operating cylinder piston 86, the entire wheel support assembly can be rotated in a clockwise manner as seen in FIG. 3 such that the wheel support frame assembly attains a vertical configuration to the right of wheel support frame axle 70.

Grinding wheel support base plate 122 is a generally triangular-shaped structural metal plate generally comprised of steel of a thickness in the order of 2 to 3 inches (5–7.5 cm). At opposite corners of the triangular grinding wheel support base plate 122, grinding wheel support axles 124 and 126 extend outwardly therefrom. Grinding wheel support axle 124 is received in bearing assembly 128 which itself is supported on grinding wheel support post assembly 132. Grinding wheel support post assembly 132 extends upwardly and is affixed to base frame plate 14 near outer lateral edges thereof. Similarly, grinding wheel support axle 126 is received in bearing assembly 130 which itself is affixed to the top of grinding wheel support post assembly 134. Grinding wheel support post assembly 134 extends upwardly from base plate 14 near lateral edges thereof.

Grinding wheel support operating cylinder 144 extends from a grinding wheel support piston attachment point 156 affixed to base frame plate 14. Grinding wheel support operating cylinder 144 is generally a hydraulic cylinder having a piston 146 extending therefrom. The end of piston 146 is attached to grinding wheel support rollover bracket 140. Rollover bracket 140 itself is attached to grinding wheel support flange 152 which extends from and is operatively connected to grinding wheel support axle 124. Similarly, an identical grinding wheel support cylinder 148 extends from a similar connection point opposite piston attachment point 156 near the other lateral edge of base support plate 14. Operating cylinder piston 150 extends from operating cylinder 148 and itself is attached to another grinding wheel support rollover bracket 142. Grinding wheel rollover bracket 142 itself is operatively connected to grinding wheel support flange 154 which is affixed to grinding wheel support axle 126. Upon the interrelated actuation of grinding wheel support operating cylinders 144 and 148, it is possible to rotate grinding wheel support base plate 180° from the operating position shown in FIG. 3 upwardly and backwardly therefrom. More details of this operation will be discussed shortly.

As seen in FIGS. 2 and 3, grinding wheel motor 160 is affixed to the top surface of grinding wheel support base plate 122. Grinding wheel motor 160 is typically a three-phase alternating current motor of 200–250 horsepower rating. Grinding wheel motor output shaft 162 is attached to an interconnection 164. In turn, grinding wheel drive shaft 166 extends from interconnection 164 and is received in a bearing support assembly 170. Bearing support assembly 170 itself is affixed to the top surface of grinding wheel support base plate 122. Grinding wheel 168 is attached to the other end of grinding wheel drive shaft 166. Grinding wheel 168 itself is a relatively large grinding wheel of about 3-inch thickness and 25-inch diameter (7.6 cm ×63 cm). Grinding wheel motor 160 and grinding wheel 168 should be selected such that the normal noload operating speed of grinding wheel 168 is about 2,625 rpm.

Grinding wheel support control cylinder 172 is affixed at one end of 178 to a support block extending upwardly and affixed to base frame plate 14. Grinding wheel support control cylinder includes a piston 180 extending therefrom and terminating in an arched end plate 174. End plate of control cylinder piston is received in a grinding wheel support seating block 176 which itself is affixed to the bottom surface of grinding wheel support base plate 122 and itself includes a key arch shaped cutout 182 into which grinding wheel support control cylinder end plate 174 is received. Upon the actuation of grinding wheel support control cylinder 172, which is most typically a hydraulic cylinder, piston 180 can extend therefrom and be retracted thereinto such that the movement of grinding wheel support base plate 122 about grinding wheel support axles 124 and 126 is controlled in a precise rising. Such movement provides for the nearly lateral movement of grinding wheel 168 toward and away from railroad wheel 34 when railroad wheel 34 is received in railroad wheel support drive roller 62 and railroad wheel support rollers 100 and 112. Of course, such contact between grinding wheel 168 and railroad wheel 34 would assume that railroad wheel support frame base plate 20 is nearly horizontal as shown in FIG. 3. As described above, if it is needed to replace grinding wheel 168, railroad wheel support frame base plate 20 and associated equipment can be rotated clockwise as shown in FIG. 3 by the withdrawal of hydraulic operating cylinder piston 86 into hydraulic operating cylinder 88 with such movement being about railroad wheel support frame axles 70 and 72. This would allow the interrelated actuation of grinding wheel support operating cylinders 144 and 148 such that grinding wheel support base plate 122 would be lifted off grinding wheel support control cylinder end plate 174 and swung counterclockwise as seen in FIG. 3 nearly 180° to open and make accessible grinding wheel 168 for any repairs or desired changeout of grinding wheel 168.

Figure 5:
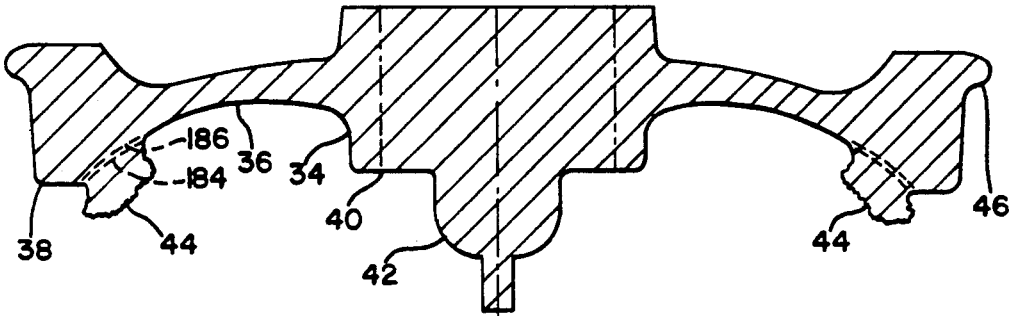
FIG. 5 is a cross section view of a cast steel railroad wheel with sprues prior to grinding.
Figure 6:
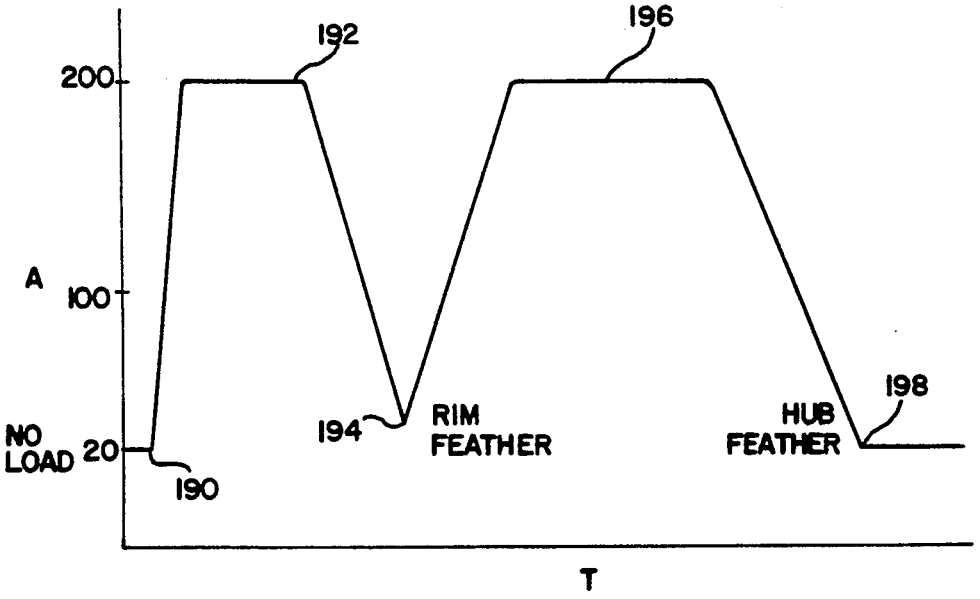
FIG. 6 is a graph of grinding motor amperage versus time in a grinding operation in accordance with the present invention.

Referring now to FIGS. 5 and 6, as well as the previously described FIGS. 1–4, a general operation of the grinding machine 10 of the present invention will be generally described. After pouring an appropriate mold, cast steel railroad wheel 34 is allowed to cool to 800°–1,200° F. (425°–650° C.). It has been discovered as part of the present invention that such wheels can be removed from the molds, usually graphite molds, at such temperature and be moved immediately to grinding machine 10 while railroad wheel 34 is at such temperature. Moving along an assembly line, railroad wheel 34 is picked up slightly by loading arm 33 and moved through entry gate 35 into grinding machine 10. Railroad wheel support rollers 100 and 112 are moved into contact with rim 38 and flange 46 of railroad wheel 34 to hold railroad wheel 34. Loading arm 33 is removed and entry gate 35 is closed. Grinding wheel 168 is moving virtually continuously whenever grinding machine 10 is in use. Appropriate control mechanisms are utilized to move wheel support frame base plate 20 in a generally clockwise fashion about railroad wheel support frame axles 70 and 72 such that the sprue area 44 of railroad wheel 34 is brought above and laterally opposite grinding wheel 168. Grinding wheel support control cylinder 172 is activated by said control mechanism such that piston 180 extends therefrom to thereby raise grinding wheel support base plate 122 and the affixed grinding wheel motor 160 and grinding wheel 168 itself. Grinding wheel 168 is thereby brought into contact with sprue area 44 of railroad wheel 34 which is now rotating due to the activation rotating about its own axis due to the activation of railroad wheel support drive rollers 62 and 64. The loading on grinding wheel motor 160 can be best measured by the amperage draw of grinding wheel motor 160. This mount is shown as the ordinate of the graph of FIG. 6. The no-load rotation of grinding wheel 168 is shown at 190 of the graph in FIG. 6. As grinding wheel 168 is brought into contact with the sprue the load amperage on grinding motor 160 increases rather rapidly to 192. With the appropriate control of hydraulic operating cylinder 88, railroad wheel 34 is rotated about railroad wheel support frame axles 70 and 72 in a generally counterclockwise manner as seen in FIG. 3. This assures the ready removal of all sprues extending from railroad wheel 34. It should be mentioned here that depending on the size and design of railroad wheel 34, from 6 to 14 such sprues can extend generally from the sprue area 44. Upon such sprue removal the output load of motor 160 decreases to 194. At this stage, the initial sprue removal grinding is completed and the wheel contours essentially as shown at 184 of FIG. 5. However, as seen in FIG. 5, the finally selected wheel contour is at 186. This is on a preselected design for the particular type of railroad wheel 34 being ground. Accordingly it is necessary for grinding to continue on grinding wheel 168 due to the controlled actuation of grinding wheel support control cylinder 172 is again brought into contact with railroad wheel 34. The output amperage load on grinding motor 160 is again measured and rises to the amount shown as 196 in FIG. 6. Such finish grinding of the railroad wheel results in finished design contour 186 being achieved. It should also be mentioned that a controlled oscillation of railroad wheel due to the extension and retraction of hydraulic cylinder 88 and piston 86 is also necessary to accomplish such finished grinding. As the final contour 186 is neared, it is seen from FIG. 6 that the motor output amperage reduces to a point 198 at which time final finish surface grinding of the wheel is accomplished. As such, it is seen that in a single operation, the rough sprue removal and finish grinding of a cast steel railroad wheel is accomplished using the apparatus and method of the present invention.

What is claimed is:

1. A grinding apparatus comprising a base frame, a railroad wheel support assembly comprising a railroad wheel support frame, railroad wheel support roller means affixed to said railroad wheel support frame, roller drive means operatively connected to a railroad wheel support drive roller means, a railroad wheel held in said railroad wheel support roller means and said railroad wheel support drive roller means such that said railroad wheel can be rotated about a center axis of said railroad wheel when said railroad wheel is held in said railroad wheel support roller means and said railroad wheel support drive roller means, a grinding support assembly comprising a grinding wheel motor, grinding wheel operatively connected to said grinding wheel motor, a grinding wheel support frame onto which said grinding wheel motor is mounted, said grinding wheel support frame being movable such that said grinding wheel can be brought into contact with said railroad wheel, railroad wheel support frame axle and bearing means, flange sections extending downwardly from said railroad wheel support frame, said flange sections including openings and bearing means which receive said railroad wheel support frame axle means, and a first operating cylinder having one end attached to said base frame, with another end of said first operating cylinder operatively attached to said railroad wheel support frame bearing means such that upon extension of said first operating cylinder, said railroad wheel support frame is rotated about said railroad wheel support frame axle means to expose a surface of said railroad wheel to said grinding wheel.

2. The grinding apparatus of claim 1 further comprising a drive motor mounted to said railroad wheel support frame, said drive motor having an output shaft operatively connected to selected wheel support roller means such that upon activation of said drive motor, said selected wheel support roller means are rotated such that said railroad wheel is rotated about its center axis.

3. The grinding apparatus of claim 2 further comprising a gear reducer, said output shaft of said drive motor connected to said gear reducer by a first belt connection means, said gear reducer having a geared output shaft connected to said selected wheel support roller means by a second belt connection means.

4. The grinding apparatus of claim 3, further comprising a wheel support roller actuating cylinder having one end operatively attached to one of said clamping arms and another end operatively attached to the other of said clamping arms such that, upon extension of said wheel support roller actuating cylinder, said two wheel support roller means are brought into contact with said railroad wheel.

5. The grinding apparatus of claim 2 further comprising two clamping arms each connected to one of two of said wheel support roller means, movement of said clamping arms resulting in movement of said two wheel support roller means to both allow the placing of said railroad wheel against said selected wheel support roller means and to close said two railroad wheel support roller means against said railroad wheel.

6. The grinding apparatus of claim 1 wherein upon full extension of said first operating cylinder, said railroad wheel support frame is rotated about said railroad wheel support frame axle means to an extent that, upon actuation of grinding wheel support operating cylinders, said grinding support assembly can be rotated about 180°.

7. The grinding apparatus of claim 1 further comprising an enclosing structure about said wheel support roller means, an entry gate moveable to allow entry of said railroad wheel into said wheel support roller means, said entry gate also moveable to close against an edge of said wheel support frame.

8. The grinding apparatus of claim 1 further comprising grinding wheel support frame axle and bearing means, flange sections extending upwardly from said grinding wheel support frame, said flange sections including openings and bearing means which receive said grinding wheel support frame axle means.

9. The grinding apparatus of claim 8 further comprising grinding wheel support operating cylinders each having one end attached to said base frame, two rollover brackets means each attached to one of said flange sections, and another end of each of said operating cylinders attached to one of said rollover bracket means, such that upon actuation of said, grinding wheel support operating cylinders, said grinding support assembly can be rotated about 180° about said grinding wheel support frame axle means.

10. The grinding apparatus of claim 8 further comprising a controlled actuating cylinder having one end attached to said base frame and another end attached to said grinding wheel support frame such that, upon extending of said controlled actuating cylinder, said grinding wheel support frame is rotated about said grinding wheel support frame axle means.

11. The grinding apparatus of claim 10 further comprising a cylindrical rod seat affixed to said grinding wheel support frame and an arcuate rod end bearing attached to said another end of said controlled actuating cylinder with said arcuate rod end bearing received in said cylindrical rod seat.

* * * * *